US006725967B2

(12) United States Patent
Hlibowicki

(10) Patent No.: US 6,725,967 B2
(45) Date of Patent: Apr. 27, 2004

(54) LOW DISTORTION LOUDSPEAKER CONE SUSPENSION

(75) Inventor: Stefan R. Hlibowicki, Toronto (CA)

(73) Assignee: Audio Products International Corp., Scarborough (CA)

( * ) Notice: Subject to any disclaimer, the term of this patent is extended or adjusted under 35 U.S.C. 154(b) by 0 days.

(21) Appl. No.: 10/267,731

(22) Filed: Oct. 10, 2002

(65) Prior Publication Data

US 2003/0070869 A1 Apr. 17, 2003

Related U.S. Application Data

(60) Provisional application No. 60/329,362, filed on Oct. 16, 2001.

(51) Int. Cl.[7] ..... G10K 11/00
(52) U.S. Cl. ..... 181/172; 181/171
(58) Field of Search ..... 181/172, 157, 181/171

(56) References Cited

U.S. PATENT DOCUMENTS

| | | | | | |
|---|---|---|---|---|---|
| 3,645,356 | A | * | 2/1972 | Sotome | 181/172 |
| 3,905,448 | A | * | 9/1975 | Kawakami et al. | 181/172 |
| 4,312,258 | A | * | 1/1982 | Park | 84/743 |
| 4,395,598 | A | * | 7/1983 | Lesage | 381/423 |
| 6,449,375 | B1 | * | 9/2002 | Hutt | 381/403 |

OTHER PUBLICATIONS

Wolfgang Klippel, Nonlinear Large–Signal Behavior of Electrodynamic Loudspeakers at Low Frequencies, J. Audio Eng. Soc., Jun. 1992, 483–496, vol. 40.

Jonathan Scott, Jonathan Kelly and Glenn Leembruggen, New Method of Characterizing Driver Linearity, J. Audio Eng. Soc., Apr. 1996, 258–265, vol. 44.

Wolfgang Klippel, The Mirror Filter—A New Basis for Reducing Nonlinear Distortion and Equalizing Response in Woofer Systems, J. Audio Eng. Soc., Sep. 1992, 675–691, vol. 40.

P.G.L. Mills and M.O.J. Hawksford, Distortion Reduction in Moving–Coil Loudspeaker Systems Using Current–Drive Technology, J. Audio Eng. Soc., Mar. 1989, 129–148, vol. 37.

Johan Suykens, Joos Vandewalle and Johan Van Ginderdeuren, Feedback Linearization of Nonlinear Distortion in Electrodynamic Loudspeakers, J. Audio Eng. Soc., Sep. 1995, 690–694, vol. 43.

Wolfgang Klippel, Dynamic Measurement and Interpretation of the Nonlinear Parameters of Electrodynamic Loudspeakers, J. Audio Eng. Soc., Dec. 1990, 944–955, vol. 38.

D. Clarc, Precision Measurment of Loudspeaker Parameters, J. Eng. Soc., Mar. 1997, 129–141, vol. 45.

* cited by examiner

*Primary Examiner*—Robert Nappi
(74) *Attorney, Agent, or Firm*—Bereskin & Parr

(57) ABSTRACT

A cone suspension is for mounting a speaker cone to a housing. The cone suspension has an inner periphery supporting the speaker cone, an outer periphery mounted to the housing, and a resilient central portion extending between the inner periphery and the outer periphery. In cross section, the resilient central portion is separated from a base plane extending between the inner periphery and the outer periphery, and has a central apex spaced from the inner periphery and the outer periphery and spaced from the base plane by a selected height. The inner periphery and the outer periphery are separated by a selected width. The selected height is substantially greater than ½ of the selected width.

31 Claims, 8 Drawing Sheets

LOW DISTORTION LOUDSPEAKER CONE SUSPENSION

FIELD OF THE INVENTION

This invention is related to a loudspeaker cone suspension geometry for reducing non-linear distortion in loudspeakers.

BACKGROUND OF THE INVENTION

The construction and operation of an electro-dynamic loudspeaker is well known in the art. It is well known that such loudspeakers exhibit non-linear distortion for various reasons, including: the displacement dependent compliance of cone suspensions and displacement dependent motor parameters, such as force factor "Bl" or voice coil inductance. The inventor has discovered that shape of a cone suspension contributes to distortion in the output of the loudspeaker.

There is a need for a speaker cone suspension (surround) which is capable of reducing non-linear distortion, particularly in low frequency, high power sub-woofers having large cone displacements.

SUMMARY OF THE INVENTION

In one aspect, the present invention provides a cone suspension with a semi-elliptical cross-section. The cone suspension creates less distortion in the sound produced by the loudspeaker in response to an audio signal that is used to displace the loudspeaker's speaker cone.

In additional embodiment, cone suspensions with paraboloic and triangular cross-sections are provided.

In another embodiment, one or more rib elements is added to the cone suspension to decrease its rigidity thereby reducing the formation of wrinkles in the suspension when the speaker cone is displaced. Such wrinkles contribute to distortion in the output of the loudspeaker and reducing them correspondingly reduces the distortion. Such rib elements may be provided on a cone suspension with a semi-circular, semi-elliptical, triangular or semi-parabolic cross section, or with another shape.

An object of an aspect of the present invention is to provide an improved loudspeaker.

In accordance with this aspect of the present invention, there is provided a loudspeaker comprising a housing; a speaker cone for displacing a volume of air; and, a cone suspension mounting the speaker cone to the housing. The cone suspension has an inner periphery supporting the speaker cone, an outer periphery mounted to the housing, and, a resilient central portion extending between the inner periphery and the outer periphery. In cross section, the resilient central portion is separated from a base plane extending between the inner periphery and the outer periphery, and has a central apex spaced from the inner periphery and the outer periphery and spaced from the base plane by a selected height. The inner periphery and the outer periphery are separated by a selected width. The selected height is substantially greater than ½ of the selected width.

An object of a second aspect of the present invention is to provide an improved a cone suspension for a loudspeaker.

In accordance with this second aspect of the present invention, there is provided a cone suspension for mounting a speaker cone to a housing. The cone suspension has an inner periphery supporting the speaker cone, an outer periphery mounted to the housing, and a resilient central portion extending between the inner periphery and the outer periphery. In cross section, the resilient central portion is separated from a base plane extending between the inner periphery and the outer periphery, and has a central apex spaced from the inner periphery and the outer periphery and spaced from the base plane by a selected height. The inner periphery and the outer periphery are separated by a selected width. The selected height is substantially greater than ½ of the selected width.

Further aspects of the present invention are illustrated and described in the following description and the attached drawings.

BRIEF DESCRIPTION OF THE DRAWINGS

For a better understanding of the present invention and to show more clearly how it may be carried into effect, reference will now be made, by way of example, to the accompanying drawings, which show preferred embodiments of the present invention, and in which.

DETAILED DESCRIPTION OF THE INVENTION

In loudspeakers, air is displaced by the movement of both the speaker cone and the speaker cone suspension, which is used to mount the speaker cone to the loudspeaker housing. In conventional speakers, the surface area of the speaker cone suspension is relatively small in comparison to the area of the cone. As the speaker is operated, cone movement results in the displacement of a main volume of air. This movement of the cone is also transferred to the cone suspension, which displaces a secondary volume of air. Consequently, the total amount of displaced air in an operational speaker is due the movement of both the cone suspension and the cone itself. In the case of conventional speakers, the secondary volume of air displaced by the cone suspension is relatively negligible in comparison to the main volume of air generated by the speaker cone. However, in high power, low frequency sub-woofer type speakers that have large cone displacements, the cone suspension area is increased to permit larger displacement of the speaker cone. This increase in cone suspension area results in a corresponding increase in the secondary volume of air displaced by the cone suspension during the operation of the speaker. Consequently, the secondary volume of air may no longer be negligible in comparison to the main volume of air displaced by the speaker cone. Any non-linearity in the displaced secondary volume of air will introduce undesirable non-linear distortion to the speaker's audio output.

Figure 1:
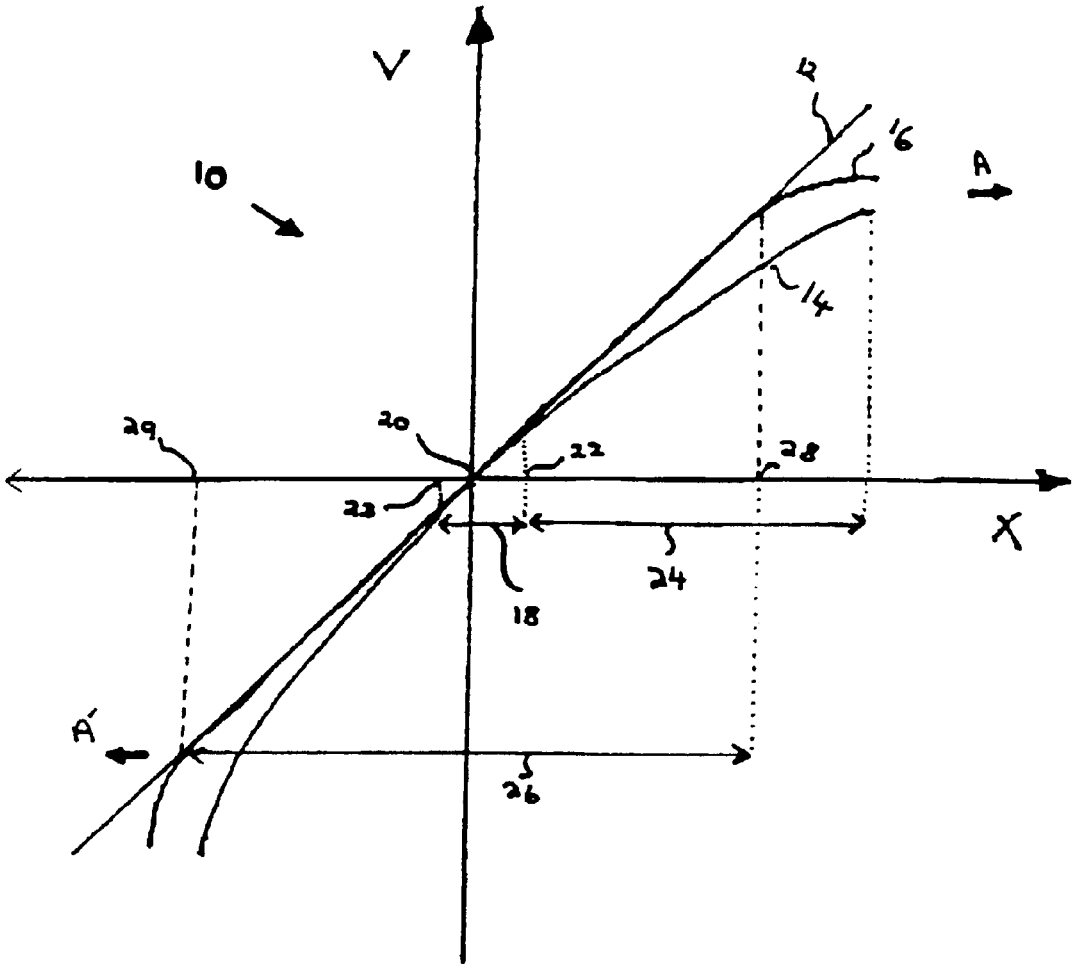
FIG. 1 illustrates a graph of displaced air volume as a function of speaker cone displacement, for an ideal case speaker cone suspension, a speaker cone suspension with a semi-circular cross-section and a speaker cone suspension with a semi-elliptical shaped cross-section.

Reference is first made to FIG. 1. Graph 10 shows the relationship between the displacement of air volume V as a function of the displacement X of a speaker cone. It will be appreciated that the displacement of air volume V is due to the displacement of air created by both the speaker cone and the cone suspension. It will also be appreciated, that as the speaker cone moves, the cone suspension also moves by expanding and contracting in synchronous to the motion of the cone to which it is attached.

Ideally, it is desirable to have a linear relationship between the displacement of air volume V and the displacement of the speaker cone X, as illustrated by line 12. As the speaker cone is displaced, a linear increase in displaced volume of air is observed. In practice, however, this ideal is not achieved, particularly for large cone displacements X.

Line 14 illustrates the displacement of air volume V as a function of the displacement of the speaker cone X, for a cone suspension having a semi-circular cross-section. Over a narrow region 18, between points 22 and 23 there is a linear relationship between the displaced volume of air V and the speaker cone displacement X. Within this region 18, a relatively small speaker cone displacement X from the rest position 20 i.e. X=0 the displaced volume of air (main volume and secondary volume) has a substantially linear relationship approximating to the ideal relationship 12. As the speaker cone displacement X increases (in the direction of arrow A or A') beyond the boundary of region 18 the displaced volume of air V varies non-linearly.

Line 16 illustrates the displacement of air volume V as a function of the displacement of the speaker cone X for a cone suspension having a semi-elliptical cross-section. Line 16 illustrates that a cone suspension with a semi-elliptical cross-section has a wider linear region 26 (between points 28 and 29) in which the relationship between the displaced volume of air V is substantially linear with the speaker cone displacement X. As illustrated in FIG. 1, the displaced volume of air as a function of the speaker cone displacement, defined by 16, has a linear relationship, wherein linearity is maintained for much larger amounts of speaker cone displacement. As the speaker cone displacement increases (direction of Arrow A and A') beyond the boundary of the linear region, defined by 28 and 29, the generated volume of air varies non-linearly as a function of the speaker cone displacement.

FIG. 1 illustrates that at some point, the displacement X of the speaker cone will produce a non-linear change in the volume of displace air V. This non-linearity produces distortion. FIG. 1 also illustrates that changing the cross-sectional geometry of the cone suspension can affect the linearity of the speaker and the amount of distortion produced by the speaker as a whole may be reduced. As previously mentioned, the non-linear secondary volume of air displaced by the cone suspension produces this distortion. Therefore, by changing the cone suspension cross-section, the linearity of the displaced volume of air V (which includes both the primary and second volumes of air) as a function of speaker cone movement is extended.

Figure 2A:
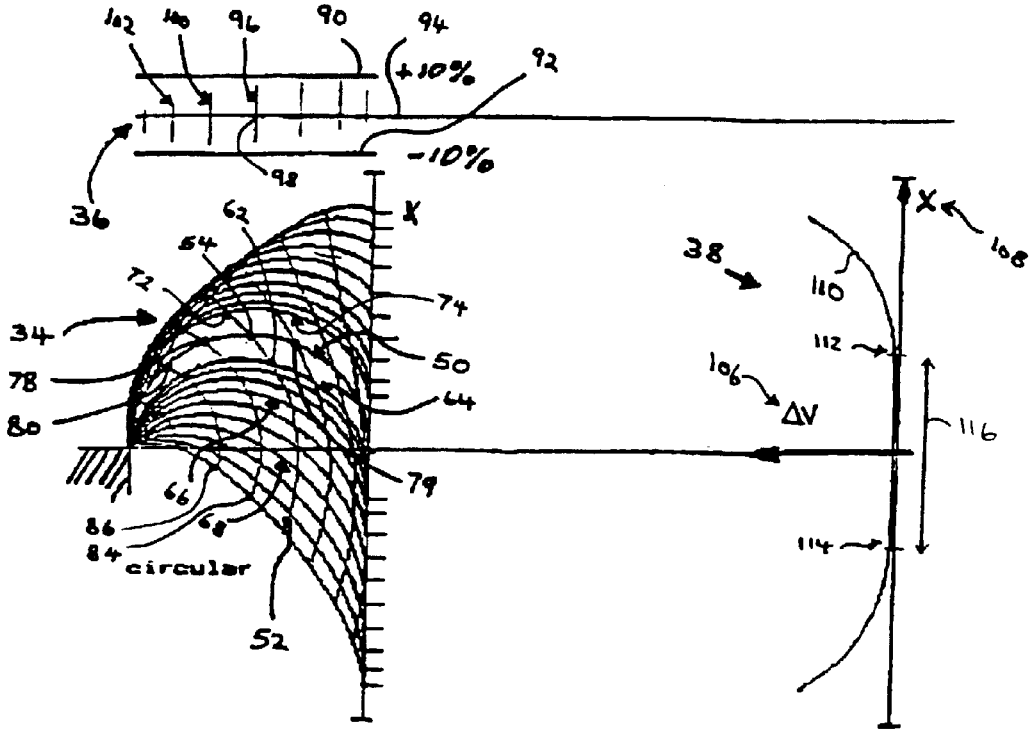
FIG. 2*a* illustrates a series of graphs which shows the expansion/contraction, surface point deviation and linearity characteristics of a speaker cone suspension with a semi-circular cross-section.
Figure 2B:
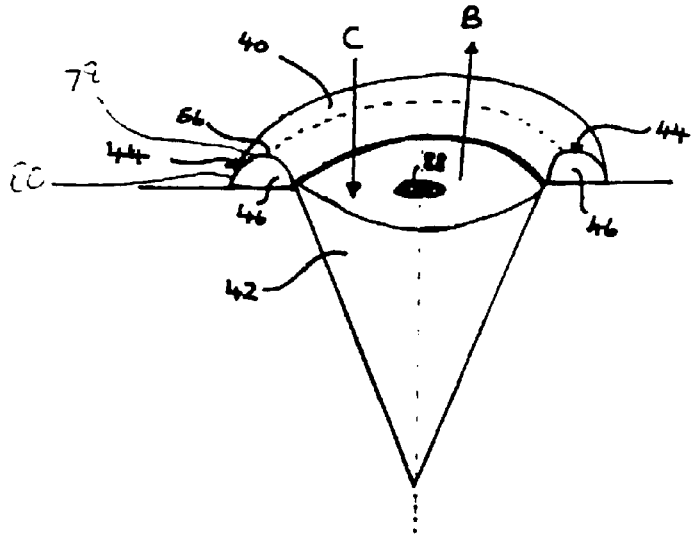
FIG. 2*b* illustrates a cross-sectional view of a speaker cone and speaker cone suspension with a semi-circular cross-section.

FIG. 2*a* illustrates a series of analysis graphs 34, 36, 38 illustrating the mechanical movement properties of a speaker with a cone suspension that has a semi-circular cross-section. These graphs 34, 36, 38 are explained with the aid of FIG. 2*b* which shows a cross-sectional view of a speaker cone 42 and a cone suspension 40 with a semi-circular cross-section. The graphs 34, 36, 38 define the behavior and performance of the cone suspension 40 as a function of the speaker cone 42 displacement. Graph 34 shows how the physical points on the surface 40 (FIG. 2*b*) of the cone suspension cross-section 46 (FIG. 2*b*) are displaced as speaker cone 42 (FIG. 2*b*) moves in the direction of arrows B and C. Curve 50 of graph 34 shows the cone suspension cross-section 46 at rest position. Contour 52 intersects curve 50 at a center point 54 on the surface of the cone suspension 40 at this rest position. The center point 54 is also shown in FIG. 2*b* at 56. Point 56 is part of a circular line connecting the midpoints of the cross-section of the cone suspension around its circumference. The center point 54 moves along contour 52 as the cone suspension moves from the rest position. For example, as the speaker cone 42 moves in the direction of arrow C by a given displacement, center point 54 moves along contour 52 to point 62 on curve 64. Curve 64 illustrates that the cross-section of the cone suspension has contracted. Further displacement of cone 42 in the direction of arrow C will continue to contract the cross-section of the cone suspension 40, as shown in curves 66 and 68 for example.

Conversely, as the cone 42 moves in the direction of arrow B by a given displacement, center point 54 moves along contour 52 to point 72 on curve 74. The cross-section of the cone suspension has expanded and will continue to do so as the cone 42 further moves in the direction of arrow B. The same explanation applies to other points 78, 80 on the surface of the cone suspension at rest position. These points 78, 80 will contract and expand along contours 84 and 86 respectively.

Graph 36 illustrates the relative radial displacement of different points on the surface of the cone suspension 40 relative to their rest positions. Relative deviation of these points occur as the speaker cone 42 is displaced when driven by an audio source (e.g. audio amplifier). Graph 36 shows two deviation limits 90, 92 marked by 10% and −10%. A center horizontal line 94 located between the two deviation limits 90, 92 identifies a zero deviation position corresponding to the speaker cone 42 in the rest position. Vertical range line 96 corresponds to the point 56 (FIG. 2*b*) at the center of the surface of the cone suspension 40. The intersection point 98 of the vertical range line 96 with the center horizontal line 94 indicates no deviation or movement of this point when the speaker cone 42 and corresponds to the cone 42 being in the rest position. Vertical range line 96 indicates the range of deviation of point 56 (FIG. 2*b*) when cone 42 is displaced by an audio source. As the speaker cone 42 moves in the direction of arrow B, point 56 (FIG. 2*b*) deviates towards the 10% deviation limit 90. Similarly, as the speaker cone 42 moves in the direction of arrow C, point 56 (FIG. 2*b*) deviates towards the −10% deviation limit 92. Therefore, vertical line 96 provides a measure of how much movement or deviation point 56 undergoes during the speaker cone 42 displacement. For point 56, vertical line 96 shows a relatively symmetrical deviation of ±8% between the deviation limits 90, 92. It will be appreciated that the same result applies to all points on the cone suspension 40 circumference, which are located at the center of the surface of the cone suspension 40 (see dotted line 56, FIG. 2*b*). Vertical lines of graph 36 of FIG. 2*a* represent maximum deviation range in both directions achievable during cone movement through its range of excursion. Maximum deviation shown by graph 36 may not necessarily occur with maximum cone displacement.

Vertical lines 100 and 102 correspond to points 78 and 80 on cone suspension 40. As indicated by lines 100 and 102 respectively, points 78 and 80 do not undergo the same range of deviation during movement of speaker cone 42. For example, vertical line 102 shows that point 80 deviates less in the direction of deviation limit 92, which corresponds to the contraction of the cone suspension 40 as the speaker cone 42 moves in the direction of arrow C. Also, point 80 deviates less in the direction of deviation limit 90, which corresponds to the expansion of cone suspension 40 as the speaker cone 42 moves in the direction of arrow B.

These variations in the deviation of points on the surface of the cone suspension 40 are determined in order to predict the occurrence of wrinkles, which occur on the surface of the cone suspension 40. These wrinkles produce audible distortion and must be accounted for in the cone suspension design process. As is described below, one embodiment of present invention provides a plurality of rib elements to the structure of the cone suspension for reducing wrinkles.

Graph 38 illustrates the relationship between the deviation (or change) in displaced air volume ($\Delta V$ represents the deviation in displaced air volume—not the displaced air volume) indicated at 106, and speaker cone displacement X, indicated at 108. Curve 110 shows that the deviation in displaced air volume $\Delta V$ no longer remains zero as the speaker cone displacement increases. As the speaker cone displacement increases past points 112 and 114, the deviation in displaced air volume $\Delta V$ is no longer zero. Consequently, only for a specific linear range 116 of speaker cone displacement X does the deviation in displaced air volume $\Delta V$ behave linearly. Outside the linear range 116 any non-linearity produces distortion at the speaker output. As previously indicated, the amount of introduced distortion depends on the ratio of the cone suspension area to the speaker cone area.

Figure 3A:
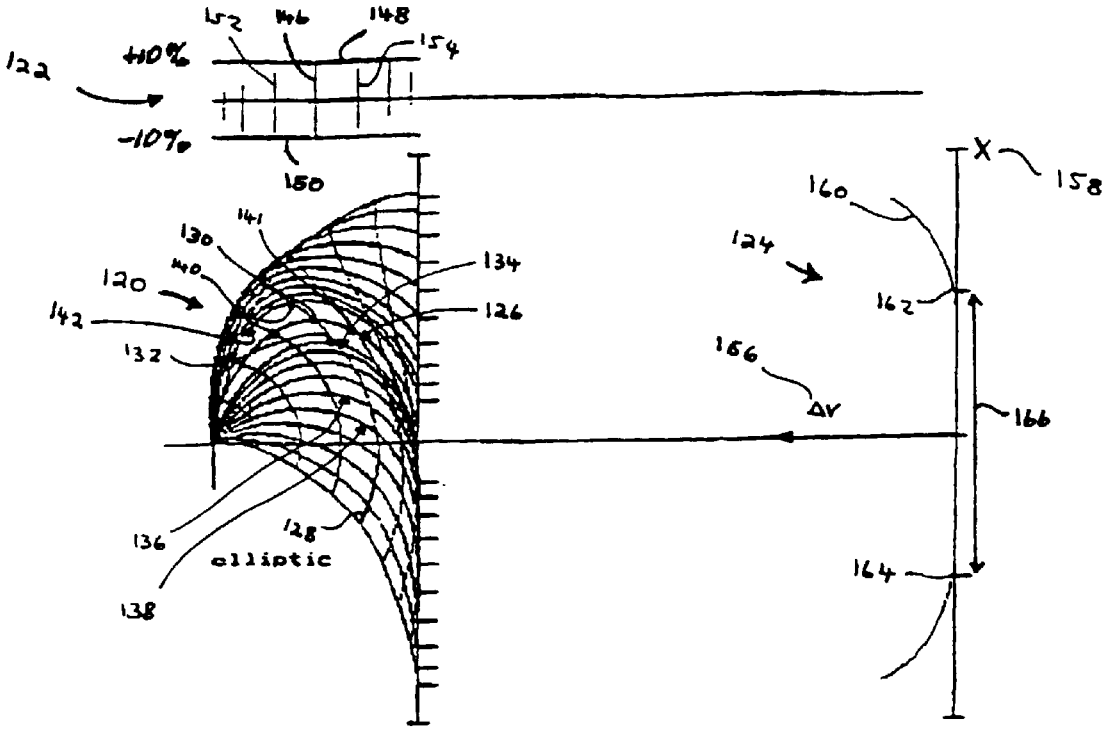
FIG. 3*a* illustrates a series of graphs which show the expansion/contraction, surface point deviation and linearity characteristics of a first speaker cone suspension in accordance with the present invention.
Figure 3B:
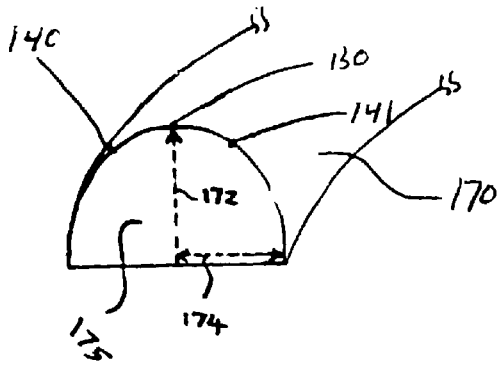
FIG. 3*b* illustrates a cross-sectional view of a speaker cone and the speaker cone suspension of FIG. 3*a;*

Reference is next made to FIGS. 3*a* and 3*b*. FIG. 3*b* illustrates the cross-section of a first embodiment of a speaker cone suspension 170 made according to the present invention. Cone suspension 170 has a semi-elliptical cross-section with a height 172 that corresponds to half the value of the major axis for the full elliptical shape, which would have otherwise been formed by completing the semi-elliptical shape of the cone suspension 170. The semi-elliptical cone suspension 170 also has a half width dimension 174 which corresponds to half the value the minor axis of the full elliptical shape which would have otherwise been formed by completing the present semi-elliptical shape.

It has been found that the distortion produced by a speaker having a semi-elliptical cone suspension, such as cone suspension 170, is less than that produced by a speaker with a semi-circular cone suspension when the height 172 exceeds half of width 174. The benefit of reduced distortion has been found in semi-elliptical cone suspension where the ratio of the height to half the width is between 1.1 to 1.7. In one example, the inventor has found that semi-elliptical cone suspension with a ratio of 1.33 produces a notable reduction in distortion.

FIG. 3*a* is set of analysis graphs 120, 122, 124 that illustrate the mechanical movement properties of cone suspension 170. Graphs 120, 122, 124 define the behavior and performance of the cone suspension as a function of the speaker cone displacement. Graph 120 shows how the physical points on the surface of the semi-elliptical shaped cone suspension cross-section are displaced as the speaker cone is displaced. Curve 126 shows the cone suspension cross-section at rest position. Contour 128 intersects curve 126 at a center point 130 on the surface of the cone suspension at rest position. The center point 130 moves along contour 128 as the cone suspension 170 moves from the rest position illustrated by curve 126. For example, as the speaker cone is displaced by a given amount in a direction away from the cone suspension, the cone suspension is contracted and the center point 130 moves along contour 128 to point 132 on curve 134. Further cone displacement will continue to contract the cross-section of the cone suspension, as shown in curves 136 and 138 for example.

Conversely, as the speaker cone is displaced by a given amount in a direction toward the cone suspension, center point 130 moves along contour 128 to point 140 on curve 142. The cross-section of the cone suspension 170 has expanded and will continue to do so as the cone further moves in the direction the cone suspension. The same explanation applies to other points on the surface of the cone suspension at rest position.

Graph 122 illustrates the relative deviation of different points on the surface of the semi-elliptical shaped cone suspension relative to the center of the speaker cone. Relative deviation of these points occurs as the speaker cone is displaced when driven by an audio source (e.g. audio amplifier).

For a given range of speaker cone displacement, 146 indicates the deviation of point 130 at the center of the surface of the cone suspension. As the speaker cone moves (from rest position) in a direction towards the cone suspension, point 130 deviates towards the 10% deviation limit 148. Similarly, as the speaker cone 42 moves in a direction away from the cone suspension, point 130 deviates towards the −10% deviation limit 150. Therefore, vertical line 146 provides a measure of how much movement or deviation point 130 undergoes during the speaker cone displacement, as it moves towards and away from the cone suspension. For point 130, vertical line 146 shows a relatively symmetrical deviation of ±10%. It will be appreciated that the same result applies to all points on the cone suspension circumference, which are located at the center of the surface of the cone suspension. Compared to the semi-circular cone suspension of FIG. 2*a*, the center points on the semi-elliptical shaped cone suspension (FIG. 3*a*) exhibit more deviation for a given amount of cone displacement.

This also holds true for the physically adjacent points 140, 141 (graph 34) on either side of point 130, wherein point 140 is represented by vertical line 152, and point 141 is represented by vertical line 154. The increased deviation for the semi-elliptical shaped cone suspension 170, which is taller than semi-circular cone suspension 40 (assuming that the width of the cone suspensions 170 and 40 is the same) makes it more prone to the occurrence of wrinkles on its cone suspension surface.

Graph 124 illustrates the relationship between the deviation (or change) in displaced air volume ΔV, indicated at 156, and speaker cone displacement X, indicated at 158. Curve 160 shows that the deviation in displaced air volume ΔV no longer remains zero as the speaker cone displacement increases. As indicated by curve 160, when the speaker cone displacement increases past points 162 and 164, the deviation in displaced air volume ΔV becomes non-zero. Consequently, for a range 166 of speaker cone displacement X the deviation in displaced air volume ΔV behaves linearly. Outside this range 166 any non-linearity translates to distortion at the speaker output. However, in comparison to the semi-circular cone suspension, the semi-elliptical suspension has a considerably wider linear range. This means that the deviation in displaced air volume ΔV remains linear for an increased range of speaker cone displacement X (i.e. range 166 is wider than range 116 (FIG. 2*a*) for cone suspension with the same width). Correspondingly, semi-elliptical cone suspension 170 suffers less non-linear distortion for increased amounts of speaker cone displacement and semicircular cone suspension 40. The improved linear performance of the semi-elliptical cone suspension was illustrated by line 16 in FIG. 1, in contrast to the performance of the semi-circular cone suspension illustrated by line 14.

Figure 4:
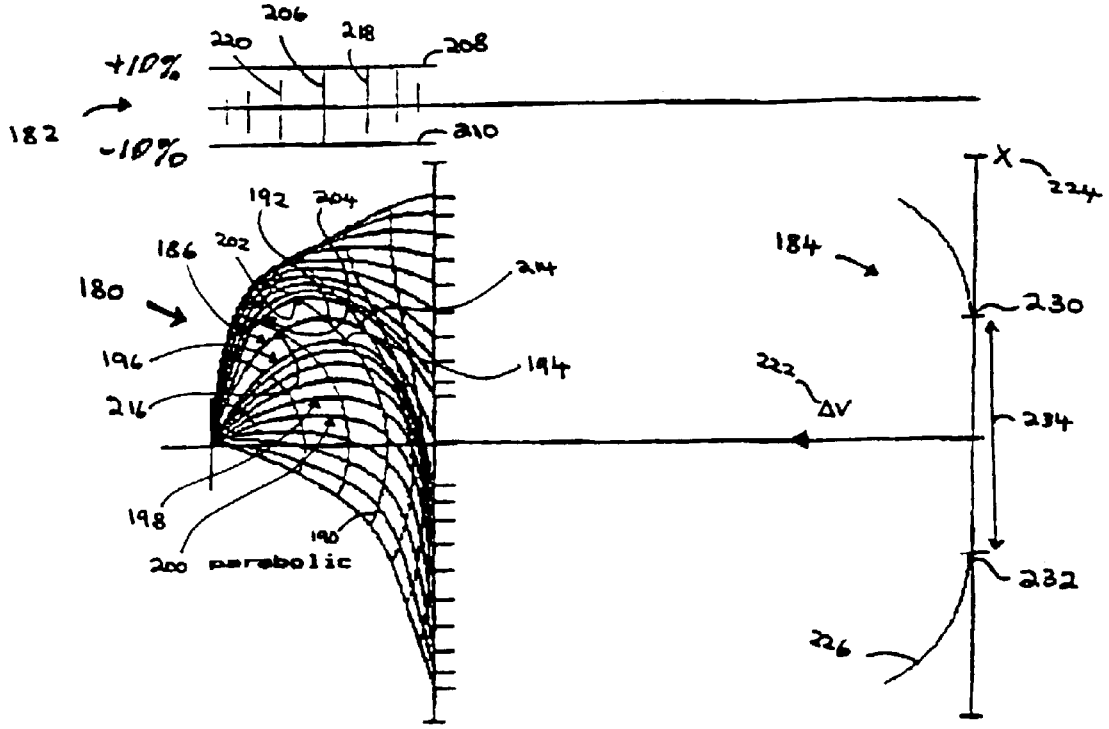
FIG. 4 illustrates a series of graphs which show the expansion/contraction, surface point deviation and linearity characteristics of a second speaker cone suspension in accordance with the present invention.

A second embodiment of the present invention is illustrated in FIG. 4. FIG. 4 illustrates the mechanical movement of a parabolic cone suspension, which illustrated in cross section by curve 186 of graph 180. Graph 180 also illustrates how the physical points on the surface of the parabolic shaped cone suspension are displaced as the speaker cone is displaced. Curve 186 of graph 180 shows the cone suspension cross-section at rest position. Contour 190 intersects curve 186 at a center point 192 on the surface of the cone suspension at rest position. The center point 192 moves along contour 190 as the cone suspension moves from the rest position. For example, as the speaker cone is displaced by a given amount in a direction away from the cone suspension, the cone suspension contracts and center point 192 moves along contour 190 to point 194 on curve 196. Further cone displacement will continue to contract the cross-section of the cone suspension, as shown in curves 198 and 200 for example.

Conversely, as the speaker cone is displaced by a given amount in a direction toward the cone suspension, center point 192 moves along contour 190 to point 202 on curve 204. Hence, the cross-section of the cone suspension has expanded and will continue to do so as the cone further moves in the direction the cone suspension. The same explanation applies to other points on the surface of the cone suspension at rest position.

Graph 182 shows simulated measurements identifying the relative deviation of different points on the surface of the parabolic shaped cone suspension relative to the center of the speaker cone. Relative deviations of these points occur as the speaker cone is displaced when driven by an audio source (e.g. audio amplifier).

For a given range of speaker cone displacement, vertical range line 206 indicates the deviation of the point 192 at the center of the surface of the cone suspension. As the speaker cone moves (from rest position) in a direction towards the cone suspension, point 192 deviates towards the 10% deviation limit 208. Similarly, as the speaker cone moves in a direction away from the cone suspension, point 192 deviates towards the −10% deviation limit 210. Therefore, vertical line 206 provides a measure of how much movement or deviation point 192 undergoes during the speaker cone displacement, as it moves towards and away from the cone suspension. For point 192, vertical line 206 shows a relatively symmetrical deviation of ±10%. It will be appreciated that the same result applies to all points on the cone suspension circumference, which are located at the center of the surface of the cone suspension. Compared to the semi-circular cone suspension of FIG. 2*a*, the center points on the parabolic shaped cone suspension (FIG. 4) exhibit more deviation for a given amount of cone displacement.

This also holds true for the physically adjacent points 214, 216 (graph 180) on either side of point 192, wherein point 214 is represented by vertical line 218, and point 216 is represented by vertical line 220.

Graph 184 illustrates the relationship between the deviation (or change) in displaced air volume ΔV, indicated at 222, and speaker cone displacement X, indicated at 224. Curve 226 shows that the deviation in displaced air volume ΔV no longer remains zero as the speaker cone displacement increases. As indicated by curve 226, when the speaker cone displacement increases past points 230 and 232, the deviation in displaced air volume ΔV becomes non-zero. Consequently, for a range 234 of speaker cone displacement X the deviation in displaced air volume ΔV behaves linearly. Hence, outside range 234, any non-linearity translates to distortion at the speaker output. However, in comparison to the semi-circular cone suspension 40 (FIG. 2*a*), the parabolic shaped suspension has a considerably wider linear range. This means that the deviation in displaced air volume ΔV remains linear for an increased amount of speaker cone deviation. By comparing FIG. 2*a* and FIG. 4, it can be seen that range 234 is wider than range 116 for cone suspension with the same width, thus indicating that the parabolic cone suspension suffers less non-linear distortion for increased amounts of speaker cone displacement. Still, in contrast with the linear range, as indicated by 116, of the semi-elliptical shaped cone suspension shown in FIG. 3*a*, the linear range, as indicated by 234, of the parabolic cone suspension is slightly narrower.

As with the semi-elliptical shaped cone suspension, the semi-parabolic cone suspension operates to reduce distortion when the ratio of the height of the cone suspension to half of its width is between 1.1 and 1.7.

Figure 5:
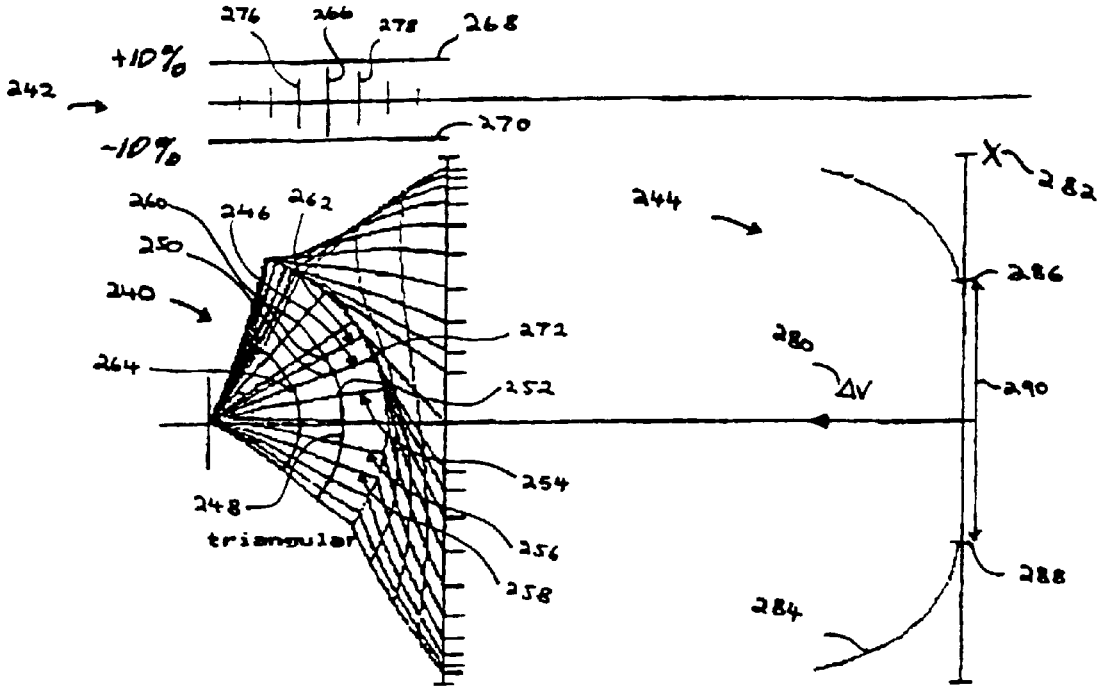
FIG. 5 illustrates a series of graphs which show the expansion/contraction, surface point deviation and linearity characteristics of a third speaker cone suspension in accordance with the present invention.

FIG. 5 illustrates a third embodiment of the present invention. FIG. 5 illustrates a cone suspension with a triangular cross-section at rest at curve 246 of graph 240. Graphs 240, 242, 244 define the behavior and performance of the triangular cone suspension as a function of the speaker cone displacement. Graph 240 shows how the physical points on the surface of the triangular shaped cone suspension cross-section are displaced as the speaker cone is displaced. Curve 246 of graph 240 shows the triangular cone suspension cross-section at rest position. Contour 248 intersects curve 246 at a center point 250 on the surface of the cone suspension at rest position. The center point 250 moves along contour 248 as the cone suspension moves from the rest position. For example, as the speaker cone is displaced by a given amount in a direction away from the cone suspension, the center point 250 moves along contour 248 to point 252 on curve 254. From curve 254, it can be seen that the cross-section of the cone suspension has contracted. Further cone displacement will continue to contract the cross-section of the cone suspension, as shown in curves 256 and 258 for example. It will be appreciated that a triangular surround moves by pivoting about its sides whilst the sides of the surround remain substantially rigid (i.e. they do not distort).

Conversely, as the speaker cone is displaced by a given amount in a direction toward the cone suspension, center point 250 moves along contour 248 to point 260 on curve 262. Hence, the cross-section of the cone suspension has expanded and will continue to do so as the cone further moves in the direction the cone suspension. The same explanation applies to other points (e.g. 264) on the surface of the cone suspension at rest position.

Graph 242 illustrates the relative deviation of different points on the surface of the triangular shaped cone suspension relative to the center of the speaker cone. Relative deviations of these points occur as the speaker cone is displaced when driven by an audio source (e.g. audio amplifier).

For a given range of speaker cone displacement, vertical range line 266 indicates the deviation of the point 250 at the center of the surface of the cone suspension. As the speaker cone moves (from rest position) in a direction towards the cone suspension, point 250 deviates towards the 10% deviation limit 268. Similarly, as the speaker cone moves in a direction away from the cone suspension, point 250 deviates towards the −10% deviation limit 270. Therefore, vertical line 266 provides a measure of how much movement or deviation point 250 undergoes during the speaker cone displacement, as it moves towards and away from the cone suspension. For point 250, vertical line 250 shows a relatively symmetrical deviation of approximately ±10%. It will be appreciated that the same result applies to all points on the cone suspension circumference, which are located at the center of the surface of the cone suspension. Compared to the semi-circular cone suspension of FIG. 2*a*, the center points on the triangular shaped cone suspension (FIG. 4) exhibit more deviation for a given amount of cone displacement.

For the points 264, 272 (graph 240) located on either side of point 250, less deviation is experienced, where this deviation continues to reduce as the points are located further away from center point 250. For example, point 264 is represented by vertical line 276, and point 272 is represented by vertical line 278.

Graph 244 illustrates the relationship between the deviation (or change) in displaced air volume ΔV, indicated at 280, and speaker cone displacement X, indicated at 282. Curve 284 shows that the deviation in displaced air volume ΔV no longer remains zero as the speaker cone displacement increases. As indicated by curve 284, when the speaker cone displacement increases past points 286 and 288, the deviation in displaced air volume ΔV becomes non-zero. Consequently, for a specific linear range of speaker cone displacement X the deviation in displaced air volume ΔV behaves linearly. Hence, outside range 290, any non-linearity translates to distortion at the speaker output. However, in comparison to the semi-circular cone suspension, the triangular shaped suspension has a considerably wider linear range. This means that the deviation in displaced air volume ΔV remains linear for an increased amount of speaker cone deviation. By comparing FIG. 2*a* and FIG. 5, it can be seen that range 290 is wider than range 116, thus indicating that the triangular cone suspension suffers less non-linear distortion for increased amounts of speaker cone displacement. In contrast to the linear range, as indicated by 116, of the semi-elliptical shaped cone suspension shown in FIG. 3*a*, the linear range, as indicated by 290, of the triangular cone suspension is approximately the same. However, the triangular cone suspension is not as practically robust as the elliptical shaped suspension cone. The fact that the triangular cone suspension pivots about its sides means that it should preferably, although not necessarily, be constructed from more rigid material than other cone suspensions. Although both the elliptical and triangular surround exhibit good linearity, the elliptical shaped cone suspension is more resilient to high internal speaker cabinet pressures, enabling the use of more lightweight and cost-effective materials in its construction.

Figure 6A:
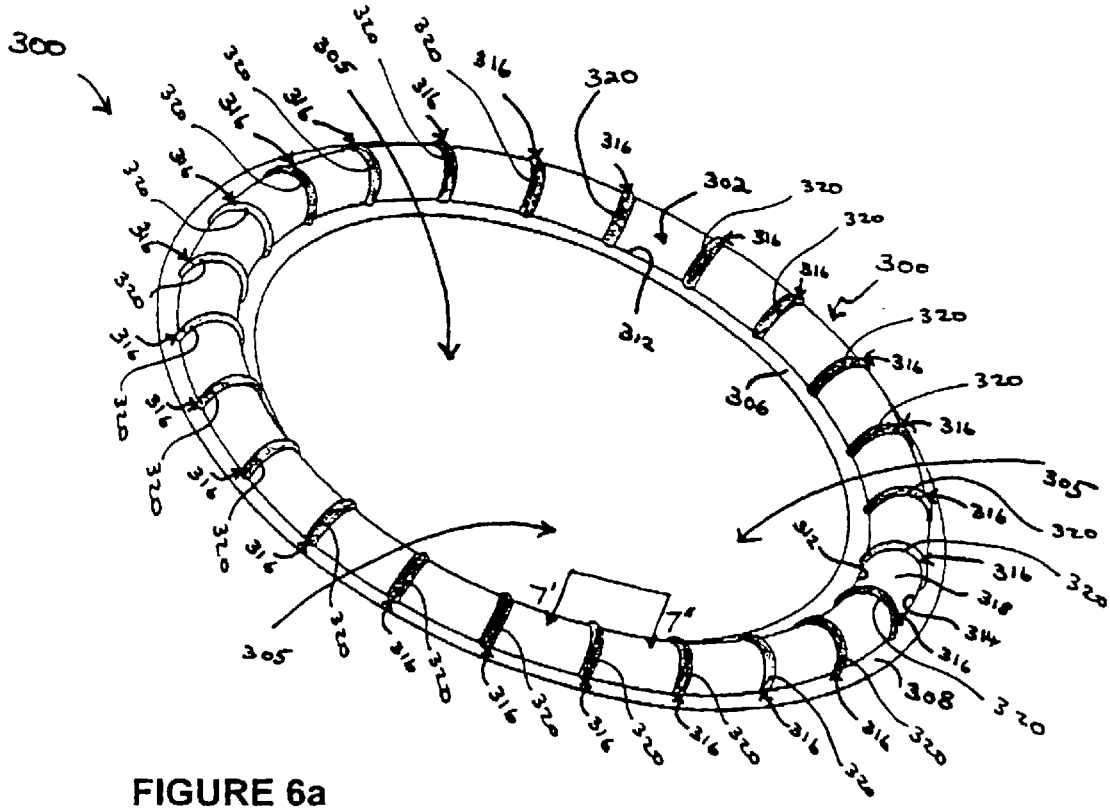
FIG. 6*a* illustrates a perspective view a fourth speaker cone suspension in accordance with the present invention.
Figure 6B:
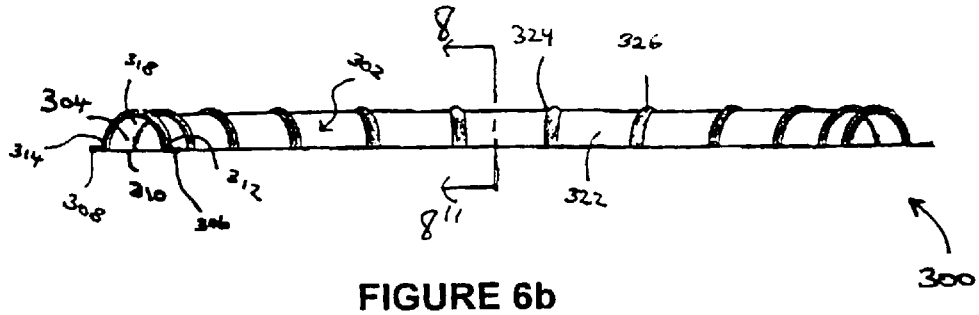
FIG. 6*b* illustrates a perspective view from the side for the speaker cone suspension shown in FIG. 6*a;*

Reference is next made to 6*a*, 6*b* and 7, which illustrate a fourth embodiment of the present invention. FIGS. 6*a* and 6*b* illustrate an annular ring shaped cone suspension 300, wherein the annular ring has a semi-elliptical shaped cross-section 304. The annular ring also includes an inner edge annular flange 306 and an outer edge annular flange 308. The inner edge annular flange 306 is adjacent to both the base 310 of the semi-elliptical shaped cross-section 304 and an inner edge 312 of the semi-elliptical shaped outer surface 302. The inner edge annular flange 306 is attached to a speaker cone in a manner known in the art of speaker construction, where generated air volume (sound) from the speaker cone passes through a circular opening 305.

The outer edge annular flange 308 is adjacent to both the base 310 of the semi-elliptical shaped cross-section 304 and an outer edge 314 of the semi-elliptical shaped outer surface 302. The outer edge annular flange 308 attaches to a speaker basket, which provides a stationary mechanical construction.

Figure 7:
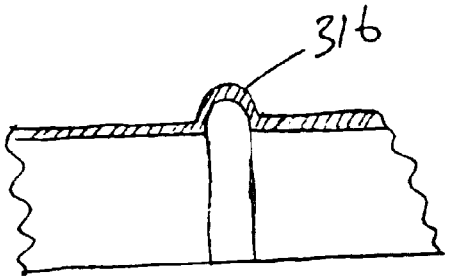
FIG. 7 illustrates a cross-sectional view of a rib element of the speaker cone suspection of FIG. 6*a;*

A plurality of rib elements 316 are circumferentially distributed on the semi-elliptical shaped outer surface 302 of the annular ring shaped cone suspension 300. The rib elements 316 can be either uniformly distributed on the semi-elliptical shaped outer surface 302 of the annular ring shaped cone suspension 300, or non-uniformly distributed. FIG. 7 illustrates a rib element 320 in cross section between lines 7' and 7' (FIG. 6). Each of the plurality of rib elements 316 has a semi-elliptical shape. Each rib may be formed integrally with the suspension 300 or the cone suspension may be assembled from a number of rib elements 316 and a number of sections of the annular ring.

Each rib element 316 extends between flanges 306 and 308. In an alternative embodiment of the present invention, the rib elements may be formed between, and spaced apart from, flanges 306 and 308.

As illustrated in FIG. 6*a*, the rectangular shaped strip 320 of material extends over the central portion 318 of the semi-elliptical shaped outer surface 302, and between the inner and outer edge 312, 314 of the semi-elliptical shaped outer surface 302. The rectangular shaped strip of material 320 also extends between the inner and outer edge annular flange 306, 308. The material used in constructing the rectangular shaped strip 320, which forms a rib element 316, can be of the same material as that used for constructing the annular ring 300. Alternatively, the material used in constructing the rectangular shaped strip 320 can be of a different type of material as that of the annular ring 300.

Figure 8:
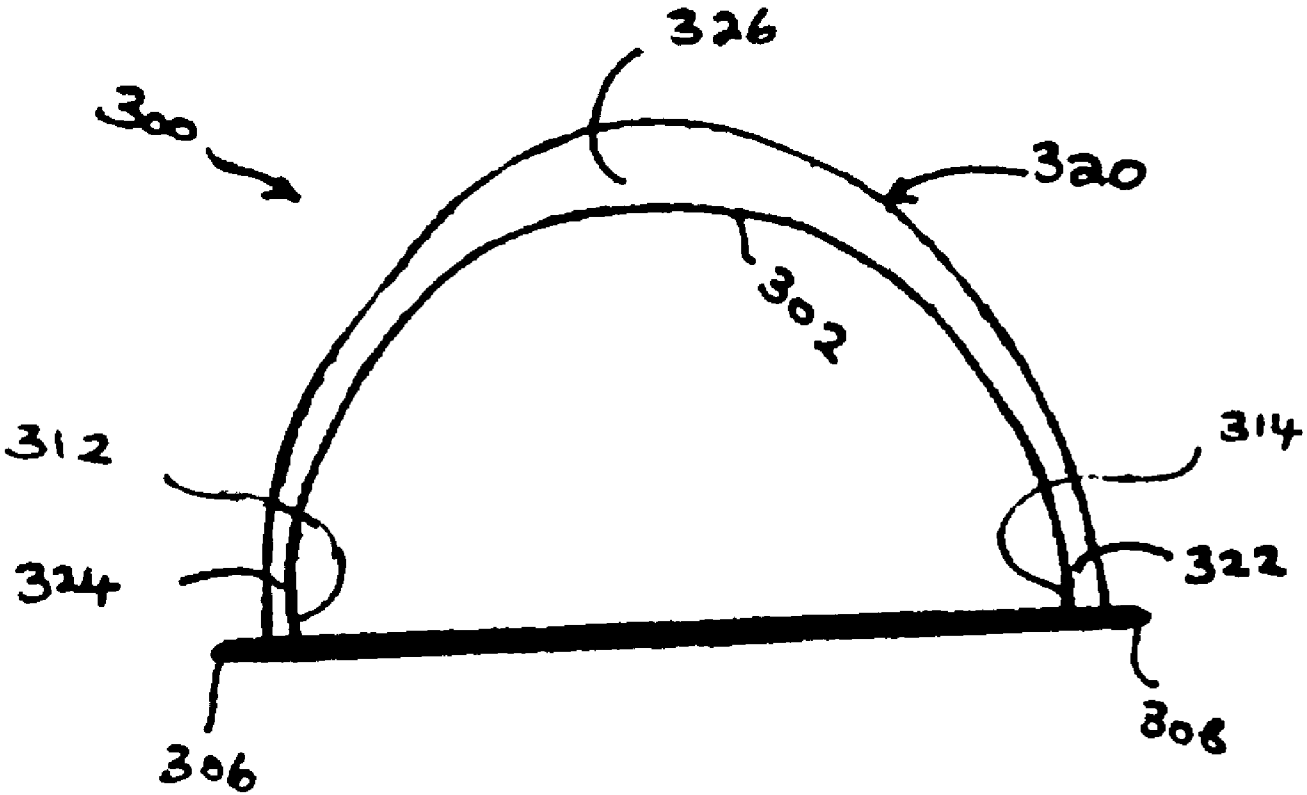
FIG. 8 illustrates a cross-sectional view of a semi-elliptically shaped rib element on the surface of the speaker cone suspension of FIG. 6*a*.

FIG. 8 is a cross-sectional view of cone suspension 300 through line 8' and 8' (FIG. 6*b*). Each elliptical rib element 316 has a first end portion 322, a second end portion 324 and a center portion 326 therebetween. The center portion 326 extends over the central portion 318 of the semi-elliptical shaped outer surface 302, whilst the first and second end portion 322, 324 extend between the outer and inner edges 314, 312 of the semi-elliptical shaped outer surface 302 respectively. The center portion 326 has an increased cross-section relative to the first and second end portion 322, 324, where the first and second end portions 322, 324 are adjacent the outer and inner edge annular flange 308, 306 of the semi-elliptical shaped outer surface 302, respectively. In an alternative embodiment of the present invention, each rib element may have a constant cross-section through its length from its first end portion 322 to its second end portion 324.

As described above in relation to semi-circular cone suspension 40 and semi-elliptical cone suspension 170, wrinkles may be formed in a cone suspension when the attached speaker cone is displaced from its rest position. A similar effect is observed in semi-parabolic cone suspensions (FIG. 4) and in cone suspensions with other shapes.

The embodiment of FIGS. 6*a*, 6*b*, 7 and 8 reduces the formation of such wrinkles. Rib elements 316 operate to decrease the rigidity of the cone suspension, reducing the formation of wrinkles and decreasing the distortion produced by the speaker. Rib elements 316 have been illustrated and described in conjunction with a semi-elliptical cone suspension. Such rib elements may also be used with semi-circular, semi-parabolic and other cone suspensions to reduce the formation of wrinkles in those cone suspensions.

The inventor has found that the use of rib elements 316 has the effect of reducing distortion whether rib elements 316 are distributed uniformly (i.e. regularly spaced) or non-uniformly. Preferably, the ribbed elements are spaced periodically to provide a consistent rigidity to the cone suspension.

Preferably, the number, position and circumferential width of the rib elements 316 are selected based on the mechanical properties of the material from which the suspension is constructed. Specifically, the rib elements 316 must be able to accommodate for the rigidity of the suspension material, as well as for the degree to which it resists stretching. In addition, the number of ribs should be selected such that the two walls of each rib element 316 do not come into contact with one another when the cone suspension is contracted. In practice, however, this situation is unlikely to arise. By suitably selecting the number, position and circumferential, rib elements can absorb the contraction and expansion of the cone suspension and reduce the formation of wrinkles in the cone suspension.

Preferably at least six ribbed elements are provided. More preferably 8 or more elements are provided. In one embodiment, the inventor has provided 12 periodically spaced rib elements. In another embodiment of the inventor has provided 24 periodically spaced rib elements on a semi-elliptical cone suspension. The addition of more ribs on a cone suspension allows shallower ribs to be used.

Figure 9A:
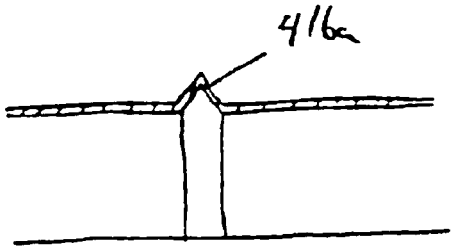
FIGS. 9*a*, 9*b* and 9*c* illustrate alternative rib element structures according to the present invention.
Figure 9B:
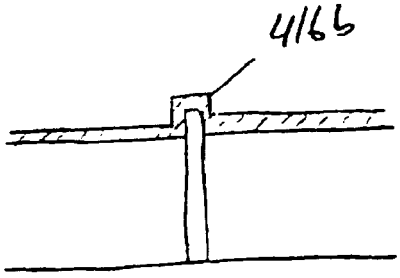
Figure 9C:
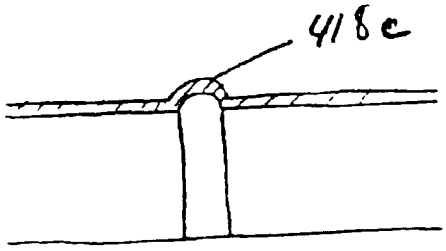

Reference is made to FIGS. 9*a*, 9*b* and 9*c*. Rib elements 316 have been described as having a semi-elliptical cross section. Alternatively, triangular rib elements 416*a*, rectangular rib elements 416*b* or semi-circular rib elements 416*c* may be used.

The embodiments of the present invention provide a loudspeaker suspension for further reducing non-linear distortion. It should be understood that various modifications can be made to the preferred and alternative embodiments described and illustrated herein without departing from the spirit and scope of the invention. For example, in FIG. 2*b* the cone suspension 40 is shown as having a contour that bends away from the cone 42. That is, the suspension 40 is convex in the direction C, and concave in the direction B. The cone suspension embodying the invention described above may, of course, be concave or convex in the direction B. Further, the cone suspension may be used either as part of a speaker including a magnet and a voice coil, or as part of passive radiator that does not include a magnet and voice coil.

What is claimed is:

1. A loudspeaker comprising:

a) a housing;

b) a speaker cone for displacing a volume of air; and, c) a cone suspension mounting the speaker cone to the housing, the cone suspension having i) an inner periphery supporting the speaker cone, ii) an outer periphery mounted to the housing, and, iii) a resilient central portion extending between the inner periphery and the outer periphery and, in cross section, being separated from a base plane extending between the inner periphery and the outer periphery, the resilient central portion having a central apex spaced from the inner periphery and the outer periphery and spaced from the base plane by a selected height, the inner periphery and the outer periphery being separated by a selected width, wherein the selected height is substantially greater than ½ of the selected width.

2. The loudspeaker as defined in claim 1, wherein the selected height is greater than 0.55 multiplied by the selected width, and is less than 0.85 multiplied by the selected width.

3. The loudspeaker as defined in claim 2, wherein the central portion has a semi-elliptical cross-section having a major dimension equal to twice the selected height, and a minor dimension equal to the selected width.

4. The loudspeaker as defined in claim 2, wherein the central portion has a parabolic cross-section.

5. The loudspeaker as defined in claim 2, wherein the central portion has a triangular cross-section.

6. The loudspeaker as defined in claim 2, wherein the inner periphery is secured to the speaker cone and the outer periphery extends radially outwards in the base plane.

7. The loudspeaker as defined in claim 6, wherein the cone suspension is integral with the speaker cone.

8. The loudspeaker as defined in claim 2, wherein the central portion has a generally uniform thickness.

9. The loudspeaker as defined in claim 1, wherein the central portion has a plurality of ribs for lateral compression and extension to accommodate compression and expansion of the cone suspension, wherein each rib in the plurality of the ribs extends generally radially between an inner end closer to the inner periphery and an outer end adjacent to the outer periphery, and is spaced from adjoining ribs in the plurality of ribs.

10. The loudspeaker as defined in claim 9, wherein the inner end of each rib is at the inner periphery, and the outer end of each rib is at the outer periphery.

11. The loudspeaker as defined in claim 9, wherein each rib in the plurality of ribs is separated from adjoining ribs by a constant distance, such that the plurality of the ribs are uniformly distributed about the cone suspension.

12. The loudspeaker as defined in claim 9, wherein each rib in the plurality of ribs has a rectangular cross-section.

13. The loudspeaker as defined in claim 9, wherein each rib in the plurality of ribs has a triangular cross-section.

14. The loudspeaker as defined in claim 9, wherein each rib in the plurality of ribs has a semicircular cross-section.

15. The loudspeaker as defined in claim 9, wherein each rib in the plurality of ribs has an elliptical cross-section.

16. The loudspeaker as defined in claim 9, wherein each rib in the plurality of ribs comprises an inner portion adjoining the inner end and an outer portion adjoining the outer end and a central portion between the inner portion and the outer portion, the rib being thicker at the central portion than at the inner portion and the outer portion.

17. The loudspeaker as defined in claim 9, wherein each rib in the plurality of ribs is of generally uniform thickness.

18. A cone suspension for mounting a speaker cone to a housing, the cone suspension having a) an inner periphery supporting the speaker cone, b) an outer periphery mounted to the housing, and, c) a resilient central portion extending between the inner periphery and the outer periphery and, in cross section, being separated from a base plane extending between the inner periphery and the outer periphery, the resilient central portion having a central apex spaced from the inner periphery and the outer periphery and spaced from the base plane by a selected height, the inner periphery and the outer periphery being separated by a selected width, wherein the selected height is substantially greater than ½ of the selected width.

19. The cone suspension as defined in claim 18, wherein the selected height is greater than 0.55 multiplied by the selected width, and is less than 0.85 multiplied by the selected width.

20. The cone suspension as defined in claim 19, wherein the central portion has a semi-elliptical cross-section having a major dimension equal to twice the selected height, and a minor dimension equal to the selected width.

21. The cone suspension as defined in claim 19, wherein the central portion has a parabolic cross-section.

22. The cone suspension as defined in claim 19, wherein the central portion has a triangular cross-section.

23. The cone suspension as defined in claim 18, further comprising a plurality of ribs for lateral compression and extension to accommodate compression and expansion of the cone suspension, wherein each rib in the plurality of ribs extends between an inner end closer to the inner periphery and an outer end closer to the outer periphery, and is spaced from adjoining ribs in the plurality of ribs.

24. The cone suspension as defined in claim 23, wherein the inner end of each rib is at the inner periphery, and the outer end of each rib is at the outer periphery.

25. The cone suspension as defined in claim 23, wherein each rib in the plurality of ribs is separated from adjoining ribs by a constant distance, such that the plurality of ribs are uniformly distributed about the cone suspension.

26. The cone suspension as defined in claim 23, wherein each rib in the plurality of ribs has a rectangular cross-section.

27. The cone suspension as defined in claim 23, wherein each rib in the plurality of ribs has a triangular cross-section.

28. The cone suspension as defined in claim 23, wherein each rib in the plurality of ribs has a semicircular cross-section.

29. The cone suspension as defined in claim 23, wherein each rib in the plurality of ribs has an elliptical cross-section.

30. The cone suspension as defined in claim 23, wherein each rib in the plurality of ribs comprises an inner portion adjoining the inner end and an outer portion adjoining the outer end and a central portion between the inner portion and the outer portion, the rib being thicker at the central portion than at the inner portion and the outer portion.

31. The cone suspension as defined in claim 23, wherein each rib in the plurality of ribs is of generally uniform thickness.

* * * * *